US012595911B2

(12) United States Patent
Zhao et al.

(10) Patent No.: US 12,595,911 B2
(45) Date of Patent: Apr. 7, 2026

(54) COAXIALLY STAGED BURNER FOR LOW-EMISSION COMBUSTION CHAMBER OF DUAL-FUEL GAS TURBINE UTILIZING GASEOUS AND LIQUID FUELS

(71) Applicant: Harbin Engineering University, Harbin (CN)

(72) Inventors: Ningbo Zhao, Harbin (CN); Zhongmin Feng, Harbin (CN); Jihao Sun, Harbin (CN); Shaowen Luo, Harbin (CN); Honghao Xu, Harbin (CN); Honglei Yang, Harbin (CN); Hongtao Zheng, Harbin (CN)

(73) Assignee: HARBIN ENGINEERING UNIVERSITY, Harbin (CN)

( * ) Notice: Subject to any disclaimer, the term of this patent is extended or adjusted under 35 U.S.C. 154(b) by 0 days.

(21) Appl. No.: 19/332,080

(22) Filed: Sep. 18, 2025

(65) Prior Publication Data

US 2026/0085837 A1 Mar. 26, 2026

(30) Foreign Application Priority Data

Sep. 20, 2024 (CN) ..... 202411318703.9

(51) Int. Cl.
*F23R 3/28* (2006.01)
*F23R 3/14* (2006.01)
(Continued)

(52) U.S. Cl.
CPC ..... *F23R 3/286* (2013.01); *F23R 3/14* (2013.01); *F23R 3/343* (2013.01); *F23R 3/36* (2013.01); *F23D 2204/10* (2013.01)

(58) Field of Classification Search
None
See application file for complete search history.

(56) References Cited

U.S. PATENT DOCUMENTS

2002/0174656 A1* 11/2002 Hein ..... F23R 3/286 60/737
2007/0028624 A1* 2/2007 Hsieh ..... F23R 3/14 60/776
(Continued)

FOREIGN PATENT DOCUMENTS

CN 111174233 B 6/2021
CN 114811655 A 7/2022
(Continued)

OTHER PUBLICATIONS

Feng Zhongmin, et al., Numerical Study on the Influence of Swirl Blade Installation Angle on the Performance of a Low Emission Combustor, Journal of Engineering for Thermal Energy and Power, 2024, pp. 106-169, vol. 39 No. 11.

*Primary Examiner* — Lorne E Meade
*Assistant Examiner* — Alyson Joan Harrington
(74) *Attorney, Agent, or Firm* — Bayramoglu Law Offices LLC

(57) ABSTRACT

The provided is a coaxially staged burner for a low-emission combustion chamber of a dual-fuel gas turbine utilizing gaseous and liquid fuels. The coaxially staged burner includes a mounting flange, a main fuel sleeve, and a swirler, where the mounting flange is provided with a fuel supply port; the main fuel sleeve is internally provided with coaxially nested four-stage fuel sleeves; the swirler includes a center pilot stage, a first premix stage, a second premix stage, a first-stage hub, and a second-stage hub; when a liquid fuel operates alone, the liquid fuel enters a swirler passage through a pilot-stage liquid fuel nozzle and a second-stage blade liquid fuel hole to achieve premixing and evaporation; and when a gaseous fuel operates alone, the gaseous fuel enters the swirler passage through a first-stage
(Continued)

blade fuel hole and a second-stage blade gaseous fuel hole for mixing.

8 Claims, 6 Drawing Sheets
(1 of 6 Drawing Sheet(s) Filed in Color)

(51) Int. Cl.
*F23R 3/34* (2006.01)
*F23R 3/36* (2006.01)

(56) References Cited

U.S. PATENT DOCUMENTS

2019/0011130 A1* 1/2019 Shershnyov ..... F23R 3/14
2022/0003415 A1* 1/2022 Shershnyov ..... F23D 14/64

FOREIGN PATENT DOCUMENTS

CN 113310071 B 11/2022
CN 119289394 A 1/2025

* cited by examiner

COAXIALLY STAGED BURNER FOR LOW-EMISSION COMBUSTION CHAMBER OF DUAL-FUEL GAS TURBINE UTILIZING GASEOUS AND LIQUID FUELS

CROSS-REFERENCE TO THE RELATED APPLICATIONS

This application is based upon and claims priority to Chinese Patent Application No. 202411318703.9, filed on Sep. 20, 2024, the entire contents of which are incorporated herein by reference.

TECHNICAL FIELD

The present disclosure relates to the technical field of gas turbine combustion chambers, and in particular to a coaxially staged burner for a low-emission combustion chamber of a dual-fuel gas turbine utilizing gaseous and liquid fuels.

BACKGROUND

A dual-fuel gas turbine employs the same type of burners to enable two types of fuel to operate stably for extended periods. The dual-fuel combustion technology broadens the application scope of gas turbines and enhances fuel utilization and economic performance of gas turbine units. During offshore extraction processes, combustible gases such as natural gas are often produced as associated gas. Although the total amount of associated gas is relatively small, failing to utilize it effectively can lead to environmental pollution and energy waste. Dual-fuel gas turbines are widely used on offshore oil and gas extraction platforms due to their advantages such as convenient maintenance and high power density.

Pollutant emissions from gas turbines are primarily related to chemical reactions of combustion in the combustion chamber, with major pollutants including nitric oxide, unburned hydrocarbons, nitrogen oxides, and soot, etc. Currently, controlling nitrogen oxide emissions is the most challenging, with thermal nitrogen oxides constituting the largest proportion. Therefore, controlling the combustion temperature is an effective method to reduce nitrogen oxide emissions. In recent years, the coaxially staged lean-premixed combustion technology proposed by domestic and international scholars shows great potential in achieving stable, low-emission combustion in combustion chambers. This technology allows effective control over the combustion zone temperature and pollutant emissions for both gaseous and liquid fuels.

In recent years, there have been many Chinese patent applications related to coaxially staged burners. Chinese patent application 202010034769.0 discloses a centrally-staged lean-premixed low-emission combustion chamber. The burner of this combustion chamber includes a center-pilot-stage film-forming air-atomizing nozzle and two stages of swirlers. The centrally-staged combustion technology effectively addresses the issues of flame stability at low-load conditions for fuel oil, as well as pollutant emissions at high-load conditions. Chinese patent application 202110664338.7 discloses a coaxially staged burner for a low-emission combustion chamber of a gas turbine utilizing a gaseous fuel. The burner includes a pilot stage and two premix stages. A tapered swirler flow passage and a Venturi structure at an outlet of the flow passage achieve fuel/air mixing and transport, enabling stable, low-emission combustion of gaseous fuel over a wide operating range and preventing flashback. Chinese patent application 202210436239.8 discloses a low-emission dual-fuel nozzle for a gas turbine. The liquid fuel undergoes diffusion combustion in the pilot stage, while the gaseous fuel undergoes premixed combustion in two stages of axially staged swirlers. This nozzle exhibits low pollutant emissions when operating on the gaseous fuel, and the liquid fuel demonstrates good combustion performance at idle and ignition conditions. However, the liquid fuel cannot operate alone under high-load conditions, and it can only maintain the same fuel supply state as at low-load conditions when the gaseous fuel undergoes the two stages of premixed combustion.

SUMMARY

The present disclosure aims to solve the problem that existing coaxially staged burners struggle to achieve stable combustion using either a single liquid fuel or a single gaseous fuel under arbitrary-load operating conditions. To this end, an objective of the present disclosure is to provide a coaxially staged burner for a low-emission combustion chamber of a dual-fuel gas turbine utilizing gaseous and liquid fuels. The present disclosure achieves stable, low-emission combustion of gaseous/liquid fuels.

To achieve the above objective, the present disclosure adopts the following technical solutions.

A coaxially staged burner for a low-emission combustion chamber of a dual-fuel gas turbine utilizing gaseous and liquid fuels includes a mounting flange 1, a main fuel sleeve 2, and a swirler 3, where the mounting flange 1, the main fuel sleeve 2, and the swirler 3 are connected in a sealed manner;

the swirler 3 includes a first-stage hub 4, multiple first-stage full blades 7, a pilot-stage bluff body 10, multiple second-stage full blades 8, a second-stage hub 5, and multiple second-stage split blades 9; the pilot-stage bluff body 10 is connected to a rear end of the main fuel sleeve 2; a liquid fuel nozzle 6 is disposed inside the pilot-stage bluff body 10; an inner periphery of the first-stage hub 4 and an outer wall of the pilot-stage bluff body 10 are connected via the multiple first-stage full blades 7; an inner periphery of the second-stage hub 5 and an outer wall of the first-stage hub 4 are connected via the multiple second-stage full blades 8; and the inner periphery of the second-stage hub 5 and the outer wall of the first-stage hub 4 are connected via multiple second-stage split blades 9; and the pilot-stage bluff body 10 and the liquid fuel nozzle 6 form a center pilot stage; the pilot-stage bluff body 10, the first-stage hub 4, and the first-stage full blades 7 form a first premix stage; and the first-stage hub 4, the second-stage hub 5, the second-stage full blades 8, and the second-stage split blades 9 form a second premix stage.

In the coaxially staged burner for a low-emission combustion chamber of a dual-fuel gas turbine utilizing gaseous and liquid fuels, the mounting flange 1 includes a pilot-stage liquid fuel port 11, a first-premix-stage gaseous fuel port 12, a second-premix-stage gaseous fuel port 13, second-premix-stage liquid fuel ports 14, and a mounting and positioning base 15; a front end of the main fuel sleeve 2 is connected to the mounting and positioning base 15; a front side of the mounting and positioning base 15 is provided with one pilot-stage liquid fuel port 11, one first-premix-stage gaseous fuel port 12, one second-premix-stage gaseous fuel port 13, and two second-premix-stage liquid fuel ports 14; and the pilot-stage liquid fuel port 11, the first-premix-stage gaseous fuel port 12, the second-premix-stage gaseous fuel port 13, and the second-premix-stage liquid fuel ports 14 are threaded to an external fuel supply pipe.

In the coaxially staged burner for a low-emission combustion chamber of a dual-fuel gas turbine utilizing gaseous and liquid fuels, the main fuel sleeve 2 is internally provided with a pilot-stage liquid fuel pipe 21, a first-stage gaseous fuel annular cavity 221, a first-stage gaseous fuel pipe 222, a second-stage gaseous fuel annular cavity 231, a second-stage gaseous fuel pipe 232, a second-stage liquid fuel annular cavity 241, a second-stage liquid fuel pipe 242, and multiple oil supply branches 243; the second-stage gaseous fuel pipe 232, the first-stage gaseous fuel pipe 222, and the second-stage liquid fuel pipe 242 are all annular pipes; the pilot-stage liquid fuel pipe 21, the second-stage gaseous fuel pipe 232, the first-stage gaseous fuel pipe 222, and the second-stage liquid fuel pipe 242 are arranged coaxially; a second-stage liquid fuel transition cavity 244, the second-stage gaseous fuel pipe 232, the first-stage gaseous fuel pipe 222, and the second-stage liquid fuel pipe 242 are arranged sequentially from inside to outside around the pilot-stage liquid fuel pipe 21; an inner wall of a rear end of the pilot-stage liquid fuel pipe 21 is provided with the second-stage liquid fuel transition cavity 244; a thin wall is disposed between the pilot-stage liquid fuel pipe 21 and the second-stage liquid fuel transition cavity 244; and the second-stage liquid fuel transition cavity 244 and the second-stage liquid fuel pipe 242 communicate in a sealed manner via the multiple oil supply branches 243 arranged circumferentially.

In the coaxially staged burner for a low-emission combustion chamber of a dual-fuel gas turbine utilizing gaseous and liquid fuels, a front end of the pilot-stage liquid fuel pipe 21 communicates with the pilot-stage liquid fuel port 11; a front end of the second-stage gaseous fuel pipe 232 communicates with the second-stage gaseous fuel annular cavity 231; the second-premix-stage gaseous fuel port 13 communicates with the second-stage gaseous fuel annular cavity 231; a front end of the first-stage gaseous fuel pipe 222 communicates with the first-stage gaseous fuel annular cavity 221; the first-premix-stage gaseous fuel port 12 communicates with the first-stage gaseous fuel annular cavity 221; a front end of the second-stage liquid fuel pipe 242 communicates with the second-stage liquid fuel annular cavity 241; and the two second-premix-stage liquid fuel ports 14 communicate with the second-stage liquid fuel annular cavity 241.

In the coaxially staged burner for a low-emission combustion chamber of a dual-fuel gas turbine utilizing gaseous and liquid fuels, the liquid fuel nozzle 6 communicates with a rear end of the pilot-stage liquid fuel pipe 21; the multiple first-stage full blades 7 are arranged at equal intervals around an axis of the pilot-stage bluff body 10; each of the first-stage full blades 7 is internally provided with a first-stage blade gaseous fuel cavity 72, a first-stage blade gaseous fuel delivery pipe 73, and a first-stage blade liquid fuel delivery pipe 74; the first-stage blade gaseous fuel cavity 72 communicates with the first-stage gaseous fuel pipe 222; an outer wall of the first-stage blade gaseous fuel cavity 72 is provided with multiple first-stage blade fuel holes 71; one end of the first-stage blade gaseous fuel delivery pipe 73 communicates with the second-stage gaseous fuel pipe 232; and one end of the first-stage blade liquid fuel delivery pipe 74 communicates with the second-stage liquid fuel transition cavity 244.

In the coaxially staged burner for a low-emission combustion chamber of a dual-fuel gas turbine utilizing gaseous and liquid fuels, the multiple second-stage full blades 8 are arranged at equal intervals around the axis of the pilot-stage bluff body 10; each of the second-stage full blades 8 is internally provided with a second-stage blade gaseous fuel cavity 82; and an outer wall of the second-stage blade gaseous fuel cavity 82 is provided with multiple second-stage blade gaseous fuel holes 81.

In the coaxially staged burner for a low-emission combustion chamber of a dual-fuel gas turbine utilizing gaseous and liquid fuels, the multiple second-stage split blades 9 are arranged at equal intervals around the axis of the pilot-stage bluff body 10; one second-stage split blade 9 is disposed between any two adjacent second-stage full blades 8; each of the second-stage split blades 9 is internally provided with a second-stage blade liquid fuel cavity 92; and an outer wall of the second-stage blade liquid fuel cavity 92 is provided with multiple second-stage blade liquid fuel holes 91.

In the coaxially staged burner for a low-emission combustion chamber of a dual-fuel gas turbine utilizing gaseous and liquid fuels, the first-stage hub 4 is a cavity structure; and the first-stage hub 4 is internally provided with a gaseous-liquid fuel separation plate 42 separating an internal space of the first-stage hub into a first-stage hub gaseous fuel flow rectification cavity 41 and a first-stage hub liquid fuel flow rectification cavity 43.

In the coaxially staged burner for a low-emission combustion chamber of a dual-fuel gas turbine utilizing gaseous and liquid fuels, the other end of the first-stage blade liquid fuel delivery pipe 74 communicates with the first-stage hub liquid fuel flow rectification cavity 43; the other end of the first-stage blade gaseous fuel delivery pipe 73 communicates with the first-stage hub gaseous fuel flow rectification cavity 41; the second-stage blade gaseous fuel cavity 82 communicates with the first-stage hub gaseous fuel flow rectification cavity 41; and the second-stage blade liquid fuel cavity 92 communicates with the first-stage hub liquid fuel flow rectification cavity 43.

In the coaxially staged burner for a low-emission combustion chamber of a dual-fuel gas turbine utilizing gaseous and liquid fuels, the first-stage full blades 7, the second-stage full blades 8, and the second-stage split blades 9 have an identical swirl direction; and mounting angles of the second-stage full blades 8 and the second-stage split blades 9 are in a range of 45°-52°.

With the above technical solutions, the present disclosure has the following positive effects compared with the prior art.

(1) The present disclosure achieves stable combustion using either a single liquid fuel or a single gaseous fuel under high- and low-load operating conditions through good fuel/air mixing within the liquid fuel nozzle of the center pilot stage, the first premix stage, and the second premix stage. Moreover, under high-load operating conditions, the reasonable arrangement of full blades and split blades within the second premix stage enables the liquid fuel to achieve a good evaporation and mixing process under the same operating conditions.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

Figure 1:
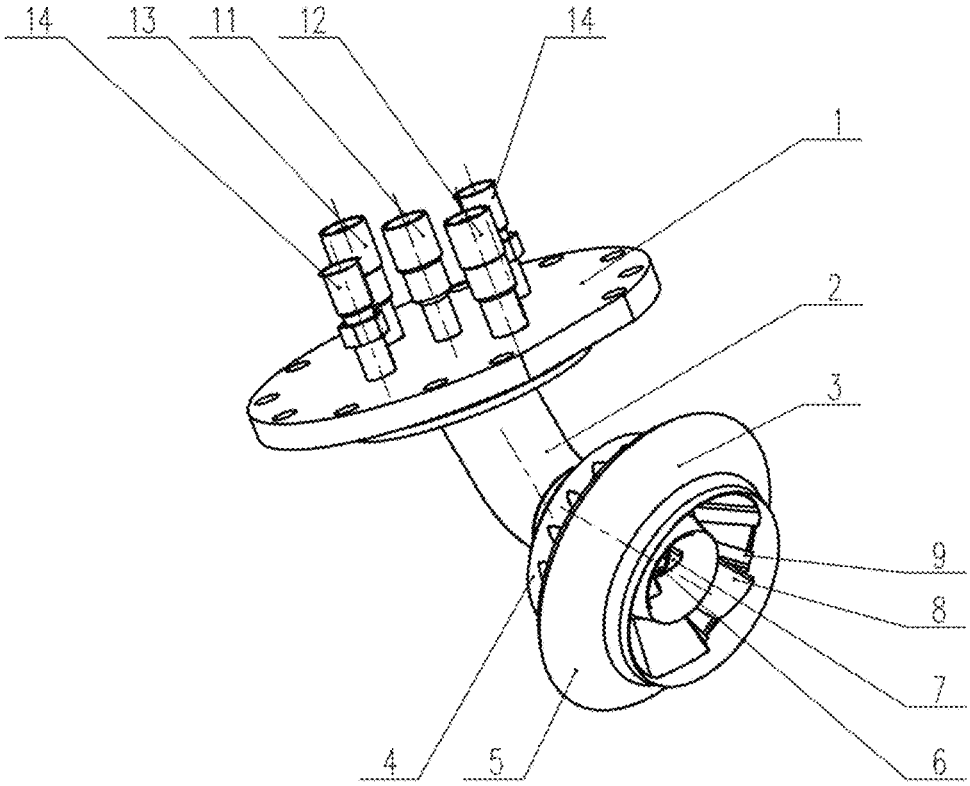
FIG. 1 is a structural view of a coaxially staged burner for a low-emission combustion chamber of a dual-fuel gas turbine utilizing gaseous and liquid fuels according to an embodiment of the present disclosure.

Reference Numerals: 1. mounting flange; 2. main fuel sleeve; 3. swirler; 4. first-stage hub; 5. second-stage hub; 6. liquid fuel nozzle; 7. first-stage full blade; 8. second-stage full blade; 9. second-stage split blade; 10. pilot-stage bluff body; 11. pilot-stage liquid fuel port; 12. first-premix-stage gaseous fuel port; 13. second-premix-stage gaseous fuel port; 14. second-premix-stage liquid fuel port; 15. mounting and positioning base; 21. pilot-stage liquid fuel pipe; 221. first-stage gaseous fuel annular cavity; 222. first-stage gaseous fuel pipe; 231. second-stage gaseous fuel annular cavity; 232. second-stage gaseous fuel pipe; 241. second-stage liquid fuel annular cavity; 242. second-stage liquid fuel pipe; 243. oil supply branch; 244. second-stage liquid fuel transition cavity; 41. first-stage hub gaseous fuel flow rectification cavity; 42. gaseous-liquid fuel separation plate; 43. first-stage hub liquid fuel flow rectification cavity; 71. first-stage blade fuel hole; 72. first-stage blade gaseous fuel cavity; 73. first-stage blade gaseous fuel delivery pipe; 74. first-stage blade liquid fuel delivery pipe; 81. second-stage blade gaseous fuel hole; 82. second-stage blade gaseous fuel cavity; 91. second-stage blade liquid fuel hole; and 92. second-stage blade liquid fuel cavity.

DETAILED DESCRIPTION OF THE EMBODIMENTS

The present disclosure is further described below with reference to the drawings and specific embodiments, but the present disclosure is not limited thereto.

Figure 2:
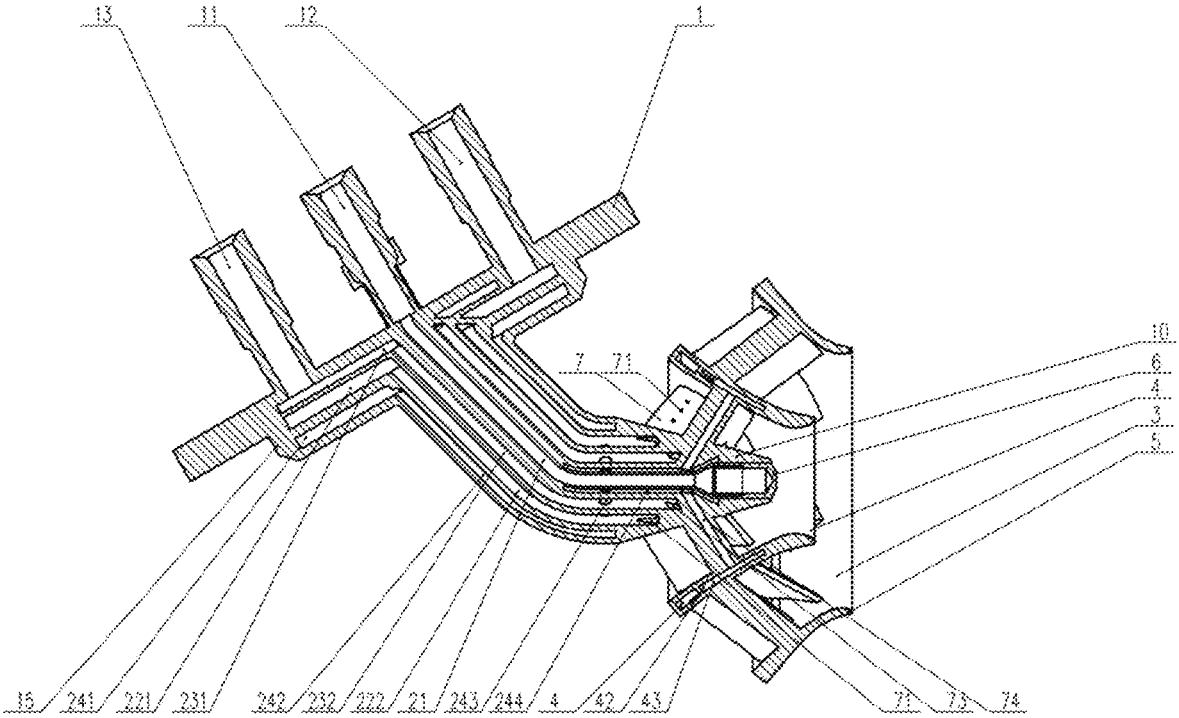
FIG. 2 is a sectional view of the coaxially staged burner for a low-emission combustion chamber of a dual-fuel gas turbine utilizing gaseous and liquid fuels according to an embodiment of the present disclosure.
Figure 3:
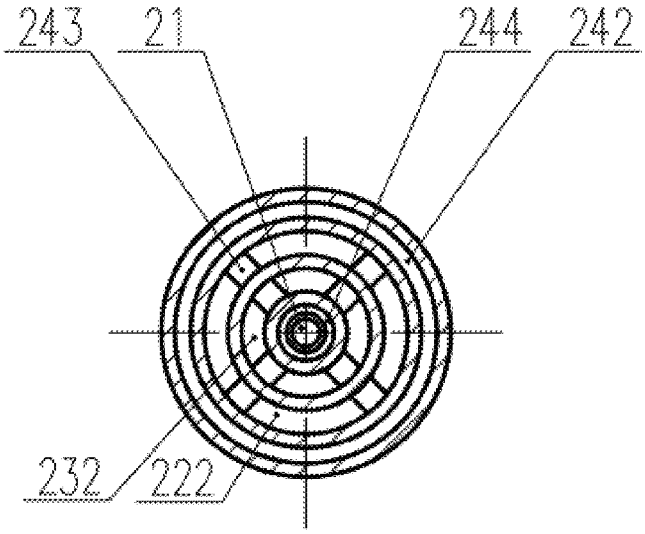
FIG. 3 is a sectional view of staged fuel sleeves at a plane of a centerline of an oil supply branch within a main fuel sleeve and the oil supply branch in the coaxially staged burner for a low-emission combustion chamber of a dual-fuel gas turbine utilizing gaseous and liquid fuels according to an embodiment of the present disclosure.
Figure 4:
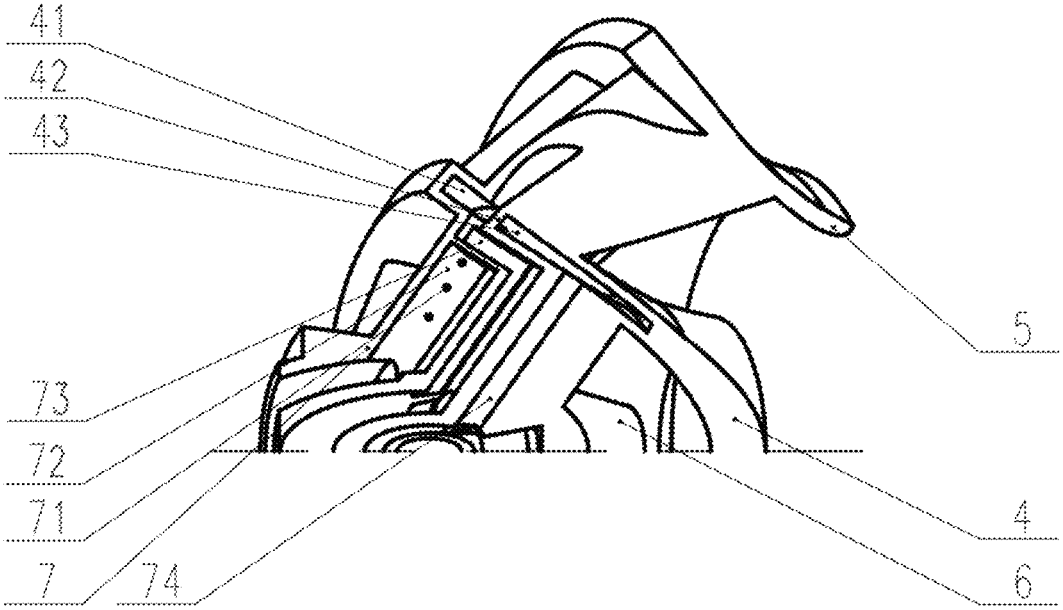
FIG. 4 is an enlarged and sectional view of a structure within a first-stage full blade in a first premix stage of a swirler portion in the coaxially staged burner for a low-emission combustion chamber of a dual-fuel gas turbine utilizing gaseous and liquid fuels according to an embodiment of the present disclosure.
Figure 5:
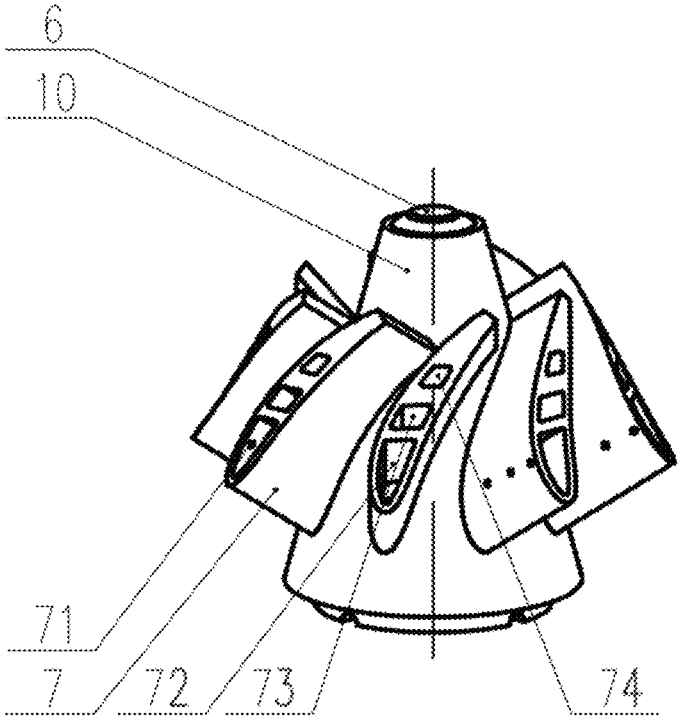
FIG. 5 is a circumferential sectional view of the first-stage full blade in the first premix stage of the swirler portion in the coaxially staged burner for a low-emission combustion chamber of a dual-fuel gas turbine utilizing gaseous and liquid fuels according to an embodiment of the present disclosure.
Figure 6:
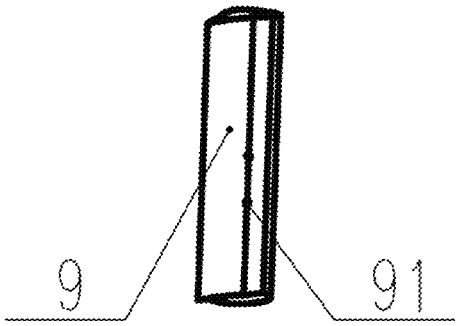
FIG. 6 is a schematic diagram of a trailing edge structure of a second-stage split blade in a second premix stage of the swirler portion in the coaxially staged burner for a low-emission combustion chamber of a dual-fuel gas turbine utilizing gaseous and liquid fuels according to an embodiment of the present disclosure.
Figure 7:
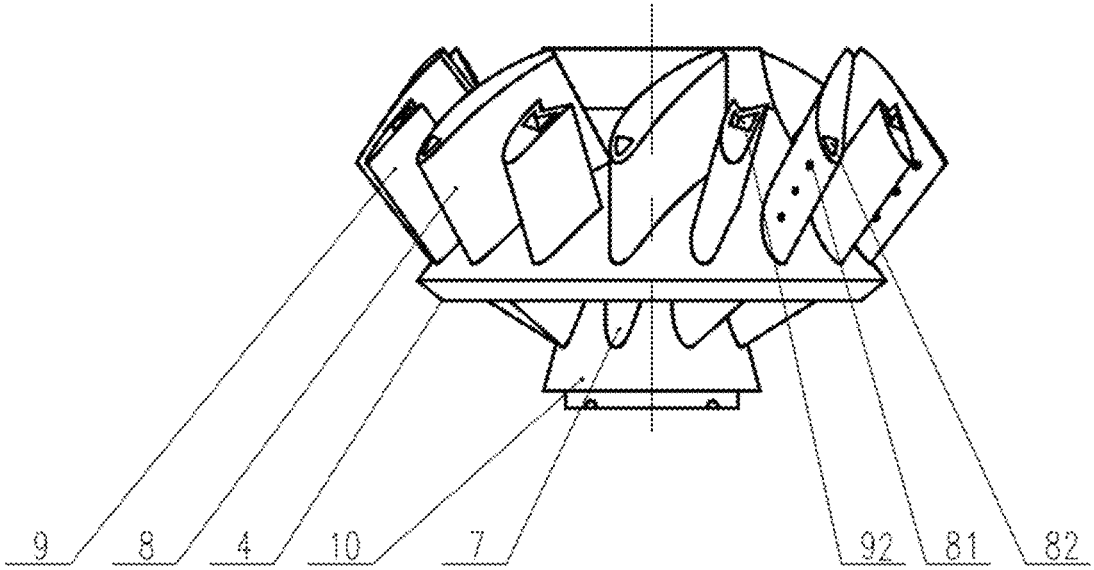
FIG. 7 is a circumferential sectional view of a second-stage full blade and the second-stage split blade in the second premix stage of the swirler portion in the coaxially staged burner for a low-emission combustion chamber of a dual-fuel gas turbine utilizing gaseous and liquid fuels according to an embodiment of the present disclosure.
Figure 8:
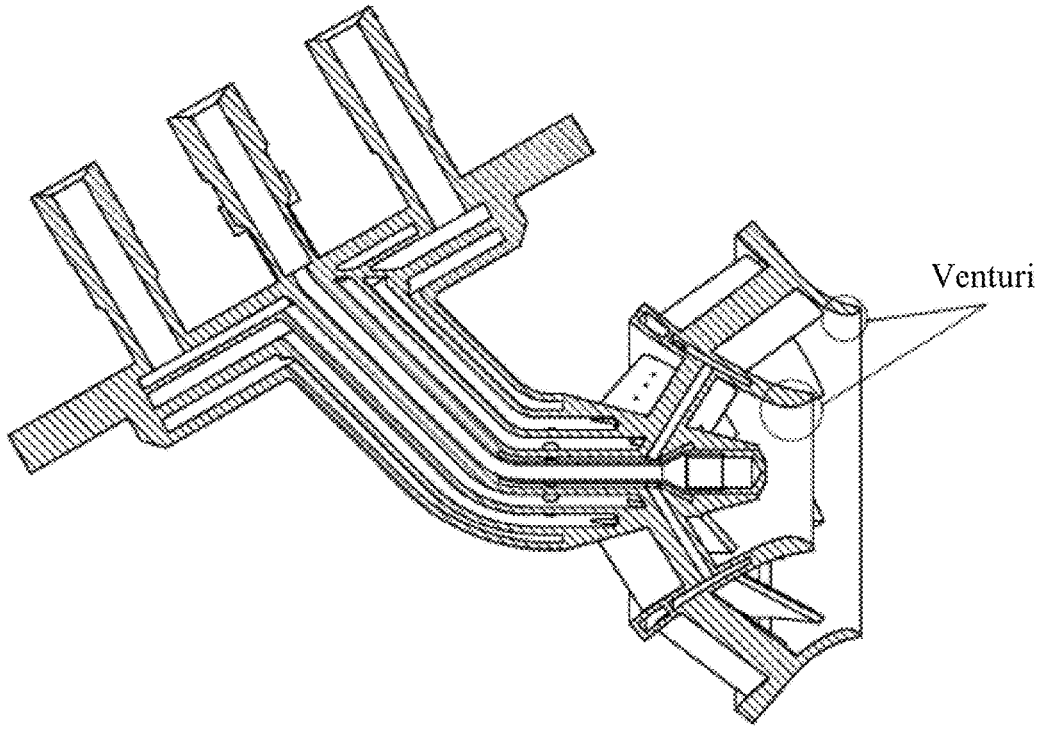
FIG. 8 is a structural view of a tapered swirler passage of two premix stages and a rear Venturi structure in the coaxially staged burner for a low-emission combustion chamber of a dual-fuel gas turbine utilizing gaseous and liquid fuels according to an embodiment of the present disclosure.
Figure 9:
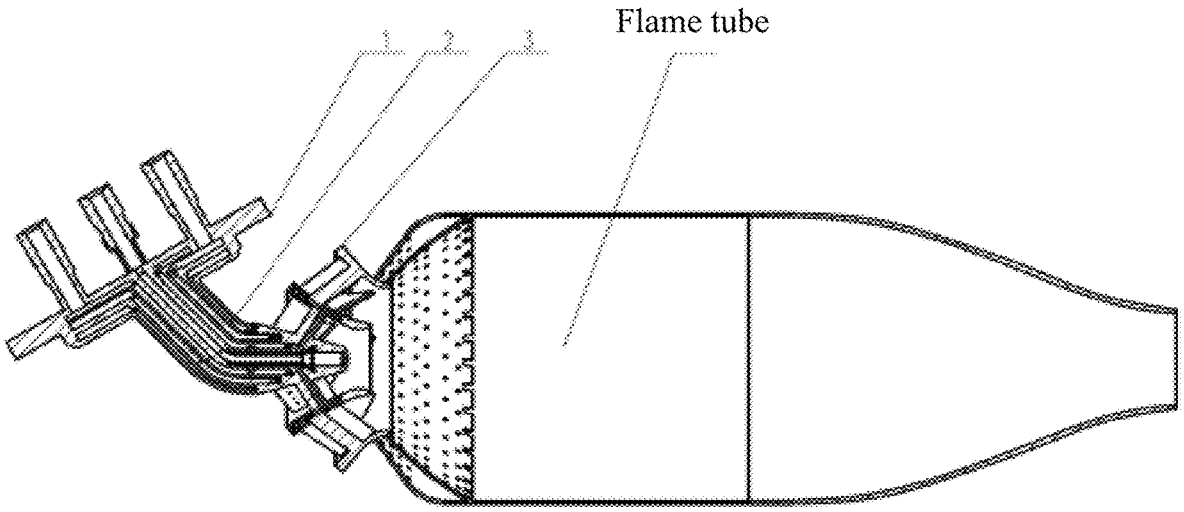
FIG. 9 is a diagram of an embodiment of the coaxially staged burner for a low-emission combustion chamber of a dual-fuel gas turbine utilizing gaseous and liquid fuels according to an embodiment of the present disclosure.
Figure 10:
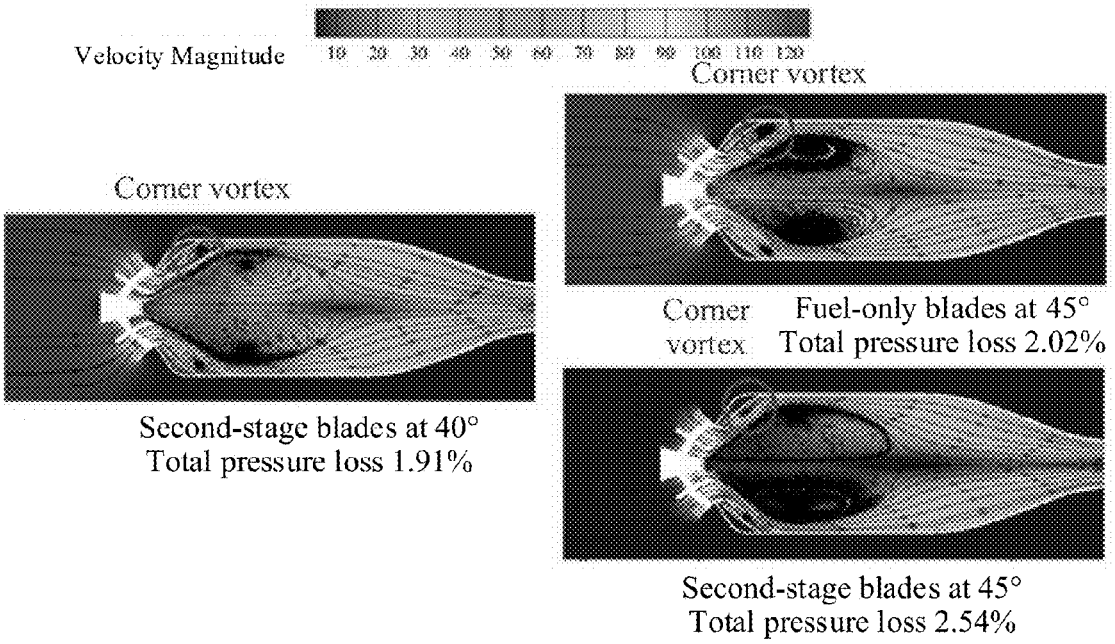
FIG. 10 is a test diagram 1 of mounting angles of the first-stage full blade, the second-stage full blade, and the second-stage split blade in the coaxially staged burner for a low-emission combustion chamber of a dual-fuel gas turbine utilizing gaseous and liquid fuels according to an embodiment of the present disclosure.
Figure 11:
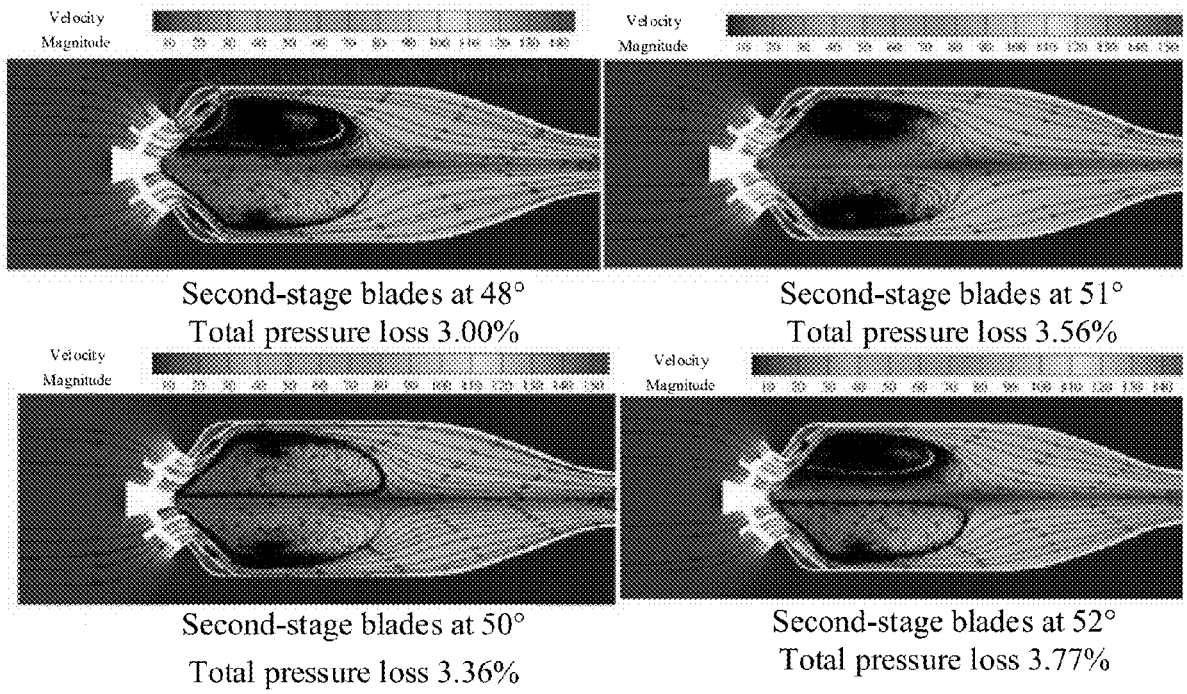
FIG. 11 is a test diagram 2 of the mounting angles of the first-stage full blade, the second-stage full blade, and the second-stage split blade in the coaxially staged burner for a low-emission combustion chamber of a dual-fuel gas turbine utilizing gaseous and liquid fuels according to an embodiment of the present disclosure.

FIGS. 1 to 11 show a coaxially staged burner for a low-emission combustion chamber of a dual-fuel gas turbine utilizing gaseous and liquid fuels. The burner includes mounting flange 1, main fuel sleeve 2, and swirler 3. The mounting flange 1, the main fuel sleeve 2, and the swirler 3 are connected in a sealed manner.

The swirler 3 includes first-stage hub 4, multiple first-stage full blades 7, pilot-stage bluff body 10, multiple second-stage full blades 8, second-stage hub 5, and multiple second-stage split blades 9. The pilot-stage bluff body 10 is connected to a rear end of the main fuel sleeve 2; a liquid fuel nozzle 6 is disposed inside the pilot-stage bluff body 10. An inner periphery of the first-stage hub 4 and an outer wall of the pilot-stage bluff body 10 are connected via the multiple first-stage full blades 7. An inner periphery of the second-stage hub 5 and an outer wall of the first-stage hub 4 are connected via the multiple second-stage full blades 8. The inner periphery of the second-stage hub 5 and the outer wall of the first-stage hub 4 are connected via multiple second-stage split blades 9.

The pilot-stage bluff body 10 and the liquid fuel nozzle 6 form a center pilot stage. The pilot-stage bluff body 10, the first-stage hub 4, and the first-stage full blades 7 form a first premix stage. The first-stage hub 4, the second-stage hub 5, the second-stage full blades 8, and the second-stage split blades 9 form a second premix stage.

Furthermore, in a preferred embodiment, the mounting flange 1 includes pilot-stage liquid fuel port 11, first-premix-stage gaseous fuel port 12, second-premix-stage gaseous fuel port 13, second-premix-stage liquid fuel ports 14, and mounting and positioning base 15. A front end of the main fuel sleeve 2 is connected to the mounting and positioning base 15. A front side of the mounting and positioning base 15 is provided with one pilot-stage liquid fuel port 11, one first-premix-stage gaseous fuel port 12, one second-premix-stage gaseous fuel port 13, and two second-premix-stage liquid fuel ports 14. The pilot-stage liquid fuel port 11, the first-premix-stage gaseous fuel port 12, the second-premix-stage gaseous fuel port 13, and the second-premix-stage liquid fuel ports 14 are threaded to an external fuel supply pipe.

Furthermore, in a preferred embodiment, the main fuel sleeve 2 is internally provided with pilot-stage liquid fuel pipe 21, first-stage gaseous fuel annular cavity 221, first-stage gaseous fuel pipe 222, second-stage gaseous fuel annular cavity 231, second-stage gaseous fuel pipe 232, second-stage liquid fuel annular cavity 241, second-stage liquid fuel pipe 242, and multiple oil supply branches 243. The second-stage gaseous fuel pipe 232, the first-stage gaseous fuel pipe 222, and the second-stage liquid fuel pipe 242 are all annular pipes. The pilot-stage liquid fuel pipe 21, the second-stage gaseous fuel pipe 232, the first-stage gaseous fuel pipe 222, and the second-stage liquid fuel pipe 242 are arranged coaxially. The second-stage liquid fuel transition cavity 244, the second-stage gaseous fuel pipe 232, the first-stage gaseous fuel pipe 222, and the second-stage liquid fuel pipe 242 are arranged sequentially from inside to outside around the pilot-stage liquid fuel pipe 21. An inner wall of a rear end of the pilot-stage liquid fuel pipe 21 is provided with the second-stage liquid fuel transition cavity 244. A thin wall is disposed between the pilot-stage liquid fuel pipe 21 and the second-stage liquid fuel transition cavity 244. The second-stage liquid fuel transition cavity 244 and the second-stage liquid fuel pipe 242 communicate in a sealed manner via the multiple oil supply branches 243 arranged circumferentially.

Furthermore, in a preferred embodiment, a front end of the pilot-stage liquid fuel pipe 21 communicates with the pilot-stage liquid fuel port 11. A front end of the second-stage gaseous fuel pipe 232 communicates with the second-stage gaseous fuel annular cavity 231. The second-premix-stage gaseous fuel port 13 communicates with the second-stage gaseous fuel annular cavity 231. A front end of the first-stage gaseous fuel pipe 222 communicates with the first-stage gaseous fuel annular cavity 221. The first-premix-stage gaseous fuel port 12 communicates with the first-stage gaseous fuel annular cavity 221. A front end of the second-stage liquid fuel pipe 242 communicates with the second-stage liquid fuel annular cavity 241. The two second-premix-stage liquid fuel ports 14 communicate with the second-stage liquid fuel annular cavity 241.

Furthermore, in a preferred embodiment, the liquid fuel nozzle 6 communicates with a rear end of the pilot-stage liquid fuel pipe 21. The multiple first-stage full blades 7 are arranged at equal intervals around an axis of the pilot-stage bluff body 10. Each of the first-stage full blades 7 is internally provided with first-stage blade gaseous fuel cavity 72, first-stage blade gaseous fuel delivery pipe 73, and first-stage blade liquid fuel delivery pipe 74. The first-stage blade gaseous fuel cavity 72 communicates with the first-stage gaseous fuel pipe 222. An outer wall of the first-stage blade gaseous fuel cavity 72 is provided with multiple first-stage blade fuel holes 71. One end of the first-stage blade gaseous fuel delivery pipe 73 communicates with the second-stage gaseous fuel pipe 232. One end of the first-stage blade liquid fuel delivery pipe 74 communicates with the second-stage liquid fuel transition cavity 244.

Furthermore, in a preferred embodiment, the multiple second-stage full blades 8 are arranged at equal intervals around the axis of the pilot-stage bluff body 10. Each of the second-stage full blades 8 is internally provided with second-stage blade gaseous fuel cavity 82. An outer wall of the second-stage blade gaseous fuel cavity 82 is provided with multiple second-stage blade gaseous fuel holes 81.

Furthermore, in a preferred embodiment, the multiple second-stage split blades 9 are arranged at equal intervals around the axis of the pilot-stage bluff body 10. One second-stage split blade 9 is disposed between any two adjacent second-stage full blades 8. Each of the second-stage split blades 9 is internally provided with second-stage blade liquid fuel cavity 92. An outer wall of the second-stage blade liquid fuel cavity 92 is provided with multiple second-stage blade liquid fuel holes 91.

Furthermore, in a preferred embodiment, the first-stage hub 4 is a cavity structure. The first-stage hub 4 is internally provided with gaseous-liquid fuel separation plate 42 separating an internal space of the first-stage hub into first-stage hub gaseous fuel flow rectification cavity 41 and first-stage hub liquid fuel flow rectification cavity 43.

Furthermore, in a preferred embodiment, the other end of the first-stage blade liquid fuel delivery pipe 74 communicates with the first-stage hub liquid fuel flow rectification cavity 43. The other end of the first-stage blade gaseous fuel delivery pipe 73 communicates with the first-stage hub gaseous fuel flow rectification cavity 41. The second-stage blade gaseous fuel cavity 82 communicates with the first-stage hub gaseous fuel flow rectification cavity 41. The second-stage blade liquid fuel cavity 92 communicates with the first-stage hub liquid fuel flow rectification cavity 43.

In a preferred embodiment, the burner is spatially compact. The ends of the second-stage gaseous fuel pipe 232 and the first-stage gaseous fuel pipe 222 communicate directly with the cavity inside the first-stage full blades 7, occupying some space circumferentially. Due to the overall structure, the end of the second-stage liquid fuel pipe 242 cannot communicate directly with the first-stage blade liquid fuel delivery pipe 74. The second-stage liquid fuel transition cavity 244 extending into the pilot-stage bluff body is required to communicate spatially with the first-stage blade liquid fuel delivery pipe 74. Thus, the first-stage blade liquid fuel delivery pipe 74 communicates with the second-stage liquid fuel nozzle 6 through a series of structures.

The pilot-stage liquid fuel pipe 21 and the second-stage liquid fuel transition cavity 244 are separated by the thin wall and do not communicate with each other. During actual operation, the pilot-stage liquid fuel pipe 21 supplies fuel for the center stage, while the second-stage liquid fuel transition cavity 244 supplies liquid fuel for the second stage. The fuel flow rates at these two locations are adjustable independently, and the two types of fuels cannot share a common path.

Furthermore, in a preferred embodiment, the first-stage full blades 7, the second-stage full blades 8, and the second-stage split blades 9 have an identical swirl direction. Mounting angles of the second-stage full blades 8 and the second-stage split blades 9 are in a range of 45°-52°.

In a preferred embodiment, the mounting angles of the first-stage full blades 7 are fixed at 40°. The mounting angles of the second-stage full blades 8 and the second-stage split blades 9 are in a range of 45°-52°. The mounting angles of the second-stage full blades 8 and the second-stage split blades 9 are kept the same, in principle, to enhance swirl and eliminate corner vortices generated inside the flame tube.

In a preferred embodiment, the swirler is an important component that imparts swirl to the incoming air and achieves fuel/air mixing. Therefore, modifying the structure must consider the swirl intensity of the swirler. The first stage must include full blades because longer blades can generate stronger swirl.

The reason for the design in the second stage is the need to inject two different types of fuels in the second stage. On one hand, full blades can generate stronger swirl compared to split blades. This setup allows for controlling the swirl intensity of the swirler within a reasonable range while simultaneously achieving dual-fuel supply. On the other hand, because split blades are shorter, designing a dual-fuel supply method within this structure is more difficult.

The split blade structure of the second-stage split blade 9 can provide injection locations for the liquid fuel. Injecting the liquid fuel within the split can prevent the fuel from impinging on the blade walls and hub walls, avoiding coke and carbon deposits from the fuel. Furthermore, a recirculation vortex can be generated within the trailing edge of the split, improving the atomization, evaporation, and mixing effects of the liquid fuel.

The above described are merely preferred embodiments of the present disclosure, and are not intended to limit the implementations and protection scope of the present disclosure.

The present disclosure further includes following implementations on the above basis.

In a further embodiment of the present disclosure, a coaxially staged burner for a low-emission combustion chamber of a dual-fuel gas turbine utilizing gaseous and liquid fuels achieves stable, low-emission lean-premixed combustion of gaseous and liquid fuels. The burner includes mounting flange 1, main fuel sleeve 2, and swirler 3. The mounting flange 1 is provided with pilot-stage liquid fuel port 11, first-premix-stage gaseous fuel port 12, second-premix-stage gaseous fuel port 13, second-premix-stage liquid fuel port 14, and mounting and positioning base 15. The main fuel sleeve 2 is internally provided with pilot-stage liquid fuel pipe 21, first-stage gaseous fuel annular cavity 221, first-stage gaseous fuel pipe 222, second-stage gaseous fuel annular cavity 231, second-stage gaseous fuel pipe 232, second-stage liquid fuel annular cavity 241, second-stage liquid fuel pipe 242, oil supply branches 243, and second-stage liquid fuel transition cavity 244. The swirler 3 is provided with first-stage hub 4, second-stage hub 5, multiple first-stage full blades 7, multiple second-stage full blades 8, second-stage split blades 9, and pilot-stage bluff body 10. The pilot-stage bluff body 10 is internally provided with liquid fuel nozzle 6.

In a further embodiment of the present disclosure, the pilot-stage bluff body 10 and the liquid fuel nozzle 6 form a center pilot stage. The pilot-stage bluff body 10, the first-stage hub 4, and the first-stage full blades 7 form a first premix stage. The first-stage hub 4, the second-stage hub 5, the second-stage full blades 8, and the second-stage split blades 9 form a second premix stage.

In a further embodiment of the present disclosure, the pilot-stage liquid fuel port 11, the first-premix-stage gaseous fuel port 12, the second-premix-stage gaseous fuel port 13, and the second-premix-stage liquid fuel port 14 are connected to the mounting flange 1 by welding. The pilot-stage liquid fuel port 11, the first-premix-stage gaseous fuel port 12, the second-premix-stage gaseous fuel port 13, and the second-premix-stage liquid fuel port 14 are threaded to an external fuel supply pipe. The mounting flange 1, the main fuel sleeve 2, and the swirler 3 are connected in a sealed manner. The manufacturing method is additive manufacturing (AM).

In a further embodiment of the present disclosure, the first-stage hub 4 is internally provided with first-stage hub gaseous fuel flow rectification cavity 41, gaseous-liquid fuel separation plate 42, and first-stage hub liquid fuel flow rectification cavity 43. The second-stage hub 5 is entirely located outside the first-stage hub 4 and is a solid shell.

In a further embodiment of the present disclosure, the first-stage full blades 7 and the second-stage full blades 8 are National Advisory Committee for Aeronautics (NACA) airfoil blades. The first-stage full blades 7, the second-stage full blades 8, and the second-stage split blades 9 have an identical swirl direction. Mounting angles of the second-stage full blades 8 and the second-stage split blades 9 are in a range of 45°-52°. The second-stage full blades 8 and the second-stage split blades 9 are arranged in a uniform and staggered manner. A number of the second-stage split blades 9 is less than or equal to 50% of a total number of blades in the second premix stage. This means the number of the second-stage split blades 9 must not exceed the number of the second-stage full blades 8, ensuring the combustion effect of the gas (natural gas) fuel and the liquid (fuel oil) fuel. The best effect is achieved when the ratio of the number of the second-stage full blades 8 to the number of the second-stage split blades 9 is 1:1.

In a further embodiment of the present disclosure, the pilot-stage liquid fuel pipe 21, the first-stage gaseous fuel pipe 222, the second-stage gaseous fuel pipe 232, and the second-stage liquid fuel pipe 242 inside the main fuel sleeve are coaxially nested and do not communicate with each other. The second-stage liquid fuel transition cavity 244 is disposed in a wall of the pilot-stage liquid fuel pipe 21. There are 2 to 8 oil supply branches 243 arranged uniformly along a circumference. The oil supply branches 243 pass through the first-stage gaseous fuel pipe 222 and the second-stage gaseous fuel pipe 232, enabling communication between the second-stage liquid fuel pipe 242 and the second-stage liquid fuel transition cavity 244.

In a further embodiment of the present disclosure, the first-stage full blade 7 includes first-stage blade fuel hole 71, first-stage blade gaseous fuel cavity 72, first-stage blade gaseous fuel delivery pipe 73, and first-stage blade liquid fuel delivery pipe 74.

In a further embodiment of the present disclosure, the second-stage full blade 8 includes second-stage blade gaseous fuel hole 81 and second-stage blade gaseous fuel cavity 82. The second-stage split blade 9 includes second-stage blade liquid fuel hole 91 and second-stage blade liquid fuel cavity 92.

In a further embodiment of the present disclosure, the first-stage blade gaseous fuel delivery pipe 73, the first-stage hub gaseous fuel flow rectification cavity 41, the second-stage blade gaseous fuel cavity 82, and the second-stage blade gaseous fuel hole 81 communicate with each other. The first-stage blade liquid fuel delivery pipe 74, the first-stage hub liquid fuel flow rectification cavity 43, the second-stage blade liquid fuel cavity 92, and the second-stage blade liquid fuel hole 91 communicate with each other.

In a further embodiment of the present disclosure, the second-stage split blade 9 is provided with 1 to 4 second-stage liquid fuel holes 91, with a diameter of 0.2-1 mm. Regardless of the blade size, the diameter of the liquid fuel hole should not be less than 0.2 mm. If the diameter is too small, the fuel oil may clog the fuel hole when passing through the fuel hole. If the diameter is too large, the fuel injection velocity under operating conditions will be too low, resulting in poorer atomization effect.

In a further embodiment of the present disclosure, a maximum diameter of the mounting and positioning base 15 on the mounting flange 1 and the second-stage hub 5 of the swirler 3 does not exceed 140 mm. Due to the flowchart limitation for mounting into the casing, assembly is impossible if the diameter exceeds 140 mm. A thread specification for the pilot-stage liquid fuel port 11, the first-premix-stage gaseous fuel port 12, the second-premix-stage gaseous fuel port 13, and the second-premix-stage liquid fuel port 14 is 16-20 mm. A maximum diameter of the main fuel sleeve 2 does not exceed 45 mm. The maximum diameter of the main fuel sleeve determines the size of the pilot-stage bluff body. A maximum diameter exceeding 45 mm may cause the pilot-stage bluff body to be too large, reducing the air intake volume of the swirler and affecting performance.

In a further embodiment of the present disclosure, the coaxially staged burner for a low-emission combustion chamber of a dual-fuel gas turbine utilizing gaseous and liquid fuels achieves the following effects. The burner achieves stable combustion using either a single liquid fuel or a single gaseous fuel under high- and low-load operating conditions through good fuel/air mixing within the liquid fuel nozzle of the center pilot stage, the first premix stage, and the second premix stage. Moreover, under high-load operating conditions, the reasonable arrangement of full blades and split blades within the second premix stage enables the liquid fuel to achieve a good evaporation and mixing process under the same operating conditions.

In a further embodiment of the present disclosure, the air intake temperature of the model combustion chamber of this type in the working environment is 770 K, reaching the evaporation temperature of fuel oil. However, the temperature of the fuel oil inside the burner is 300 K, as it is supplied to the flame tube at ambient temperature. The temperature inside the pipes close to the combustion zone of the flame tube may increase slightly due to heat convection and radiation, but it will not cause the fuel oil to evaporate inside the pipes. When injected into the flame tube from the burner nozzle, the fuel oil gradually evaporates from liquid to gaseous state. This process is very short, and good atomization in the liquid state promotes more uniform evaporation and mixing.

In a further embodiment of the present disclosure, the center pilot stage specifically refers to a structure composed of the pilot-stage bluff body 10 and the liquid fuel nozzle 6. In the embodiment of the present disclosure, the first premix stage specifically refers to a structure composed of the pilot-stage bluff body 10, the first-stage hub 4, and the first-stage full blades 7. In the embodiment of the present disclosure, the second premix stage specifically refers to a structure composed of the first-stage hub 4, the second-stage hub 5, the second-stage full blades 8, and the second-stage split blades 9. The reasonable design of the internal structure of the first-stage hub 4 allows the fuel to be supplied to the designated locations. This structure can provide a certain flow rectification effect. Otherwise, directly connecting it through a passage to the designated nozzle location in the second-stage might cause fluctuations in fuel injection.

In a further embodiment of the present disclosure, the coaxially staged burner has four operating states: a liquid fuel low-load operating state, a liquid fuel high-load operating state, a gaseous fuel low-load operating state, and a gaseous fuel high-load operating state.

In a further embodiment of the present disclosure, when in the liquid fuel low-load operating state, the pilot-stage liquid fuel port 11 is connected to an external supply structure for the pilot-stage liquid fuel. The liquid fuel enters the pilot-stage liquid fuel pipe 21, and is finally injected into the combustion chamber through the liquid fuel nozzle 6 at the end of the pilot-stage liquid fuel pipe 21 for atomization, thereby entering the swirled air stream for diffusion combustion.

In a further embodiment of the present disclosure, when in the liquid fuel high-load operating state, the pilot-stage liquid fuel port 11 and the second-premix-stage liquid fuel port 14 are connected to external supply structures for the pilot-stage liquid fuel and the second-premix-stage liquid fuel, respectively. The flow rates of the two liquid fuel streams through the pilot-stage liquid fuel port 11 and the second-premix-stage liquid fuel port 14 are adjustable independently without affecting each other. The pilot-stage liquid fuel enters the pilot-stage liquid fuel pipe 21 and is injected into the combustion chamber through the liquid fuel nozzle 6 at the end of the pilot-stage liquid fuel pipe 21 for atomization, finally entering the combustion chamber for diffusion combustion. Meanwhile, the second-premix-stage liquid fuel passes through the second-stage liquid fuel annular cavity 241, the second-stage liquid fuel pipe 242, the oil supply branches 243, the second-stage liquid fuel transition cavity 244, the first-stage blade liquid fuel delivery pipe 74, and the first-stage hub liquid fuel flow rectification cavity 43 to enter the second-stage blade liquid fuel cavity 92. It is then injected into the swirled air stream through the second-stage blade liquid fuel hole 91 for premixing and evaporation, thereby entering the combustion chamber for lean-premixed combustion.

In a further embodiment of the present disclosure, when in the gaseous fuel low-load operating state, the first-premix-stage gaseous fuel port 12 is connected to an external supply structure for the first-premix-stage gaseous fuel. The first-premix-stage gaseous fuel enters the first-stage gaseous fuel annular cavity 221, the first-stage gaseous fuel pipe 222, and the first-stage blade gaseous fuel cavity 72. It is then injected into the swirled air stream through the first-stage blade fuel holes 71 for premixing, thereby entering the combustion chamber for lean-premixed combustion.

In a further embodiment of the present disclosure, when in the gaseous fuel high-load operating state, the first-premix-stage gaseous fuel port 12 and the second-premix-stage gaseous fuel port 13 are connected to external supply structures for the first-premix-stage gaseous fuel and the second-premix-stage gaseous fuel, respectively. The flow rates of the two gaseous fuel streams through the first-premix-stage gaseous fuel port 12 and the second-premix-stage gaseous fuel port 13 are adjustable independently without affecting each other. The first-stage gaseous fuel enters the first-stage gaseous fuel annular cavity 221, the first-stage gaseous fuel pipe 222, and the first-stage blade gaseous fuel cavity 72, and enters the swirled air stream through the first-stage blade fuel hole 71 for premixing, thereby entering the combustion chamber for lean-premixed combustion. Meanwhile, the second-premix-stage gaseous fuel passes through the second-stage gaseous fuel annular cavity 231, the second-stage gaseous fuel pipe 232, the first-stage blade gaseous fuel delivery pipe 73, and the first-stage hub gaseous fuel flow rectification cavity 41 to enter the second-stage blade gaseous fuel cavity 82. It is then injected into the swirled air stream through the second-stage blade gaseous fuel hole 81 for premixing, thereby entering the combustion chamber for lean-premixed combustion.

In a further embodiment of the present disclosure, the coaxially staged burner includes mounting flange 1, main fuel sleeve 2, and swirler 3. The mounting flange 1 is provided with a fuel supply port. The main fuel sleeve 2 is internally provided with coaxially nested four-stage fuel sleeves. The swirler 3 includes a center pilot stage, a first premix stage, a second premix stage, first-stage hub 4, and second-stage hub 5. The blades of the first premix stage are all first-stage full blades 7. The blades of the second premix stage are second-stage full blades 8 and multiple second-stage split blades 9 arranged in a staggered and uniform manner. When the liquid fuel operates alone, the fuel enters a swirler passage through pilot-stage liquid fuel nozzle 6 and second-stage blade liquid fuel hole 91 to achieve premixing and evaporation. When the gaseous fuel operates alone, the fuel enters the swirler passage through first-stage blade fuel hole 71 and second-stage blade gaseous fuel hole 81 for mixing. The present disclosure adopts the tapered swirler passage in the two premix stages and the rear Venturi structure, and the second-stage full blades 8 and the second-stage split blades 9 are arranged in a uniform and staggered manner, achieving stable, low-pollution lean-premixed combustion of gaseous and liquid fuels.

In a further embodiment of the present disclosure, specifically, the outer wall of the pilot-stage bluff body 10 and the inner wall of the first-stage hub 4, and the outer wall of the first-stage hub 4 and the inner wall of the second-stage hub 5 form the tapered swirler passage of the two premix stages. The ends of the first-stage hub 4 and the second-stage hub 5 form the Venturi structure.

In a further embodiment of the present disclosure, the structure of the present disclosure is improved from a gaseous fuel burner to a dual-fuel burner. There is already a well-established system of papers and patents for gaseous fuel structures. The specific difference between the structure of the present disclosure and those gaseous fuel structures lies in that the structure of the present disclosure can achieve dual-fuel combustion with a head air intake volume exceeding 70% under the condition that the gas supply scheme remains completely unchanged and the structure remains unaltered.

The above embodiments are merely preferred examples of the present disclosure, which are not intended to limit the implementation and protection scope of the present disclosure. It should be noted by those skilled in the art that all equivalent replacements and obvious changes made by using the description of the present disclosure and the content of the drawings should be included in the protection scope of the present disclosure.

What is claimed is:

1. A coaxially staged burner for a low-emission combustion chamber of a dual-fuel gas turbine utilizing gaseous and liquid fuels, comprising: a mounting flange (1), a main fuel sleeve (2), and a swirler (3), wherein the mounting flange (1), the main fuel sleeve (2), and the swirler (3) are connected in a sealed manner;

the swirler (3) comprises a first-stage hub (4), a plurality of first-stage full blades (7), a pilot-stage bluff body (10), a plurality of second-stage full blades (8), a second-stage hub (5), and a plurality of second-stage split blades (9); the pilot-stage bluff body (10) is connected to a rear end of the main fuel sleeve (2); a liquid fuel nozzle (6) is disposed inside the pilot-stage bluff body (10); an inner periphery of the first-stage hub (4) and an outer wall of the pilot-stage bluff body (10) are connected via the plurality of first-stage full blades (7); an inner periphery of the second-stage hub (5) and an outer wall of the first-stage hub (4) are connected via the plurality of second-stage full blades (8); and the inner periphery of the second-stage hub (5) and the outer wall of the first-stage hub (4) are connected via the plurality of second-stage split blades (9); and the pilot-stage bluff body (10) and the liquid fuel nozzle (6) form a center pilot stage; the pilot-stage bluff body (10), the first-stage hub (4), and the plurality of first-stage full blades (7) form a first premix stage; and the first-stage hub (4), the second-stage hub (5), the plurality of second-stage full blades (8), and the plurality of second-stage split blades (9) form a second premix stage;

wherein the plurality of second-stage full blades (8) are arranged at equal intervals around an axis of the pilot-stage bluff body (10); each of the plurality of second-stage full blades (8) is internally provided with a second-stage blade gaseous fuel cavity (82); and an outer wall of the second-stage blade gaseous fuel cavity (82) is provided with a plurality of second-stage blade gaseous fuel holes (81);

wherein the plurality of second-stage split blades (9) are arranged at equal intervals around the axis of the pilot-stage bluff body (10); one second-stage split blade (9) is disposed between any two adjacent second-stage full blades (8); each of the plurality of second-stage split blades (9) is internally provided with a second-stage blade liquid fuel cavity (92); and an outer wall of the second-stage blade liquid fuel cavity (92) is provided with a plurality of second-stage blade liquid fuel holes (91).

2. The coaxially staged burner for the low-emission combustion chamber of the dual-fuel gas turbine utilizing gaseous and liquid fuels according to claim 1, wherein the mounting flange (1) comprises a pilot-stage liquid fuel port (11), a first-premix-stage gaseous fuel port (12), a second-premix-stage gaseous fuel port (13), second-premix-stage liquid fuel ports (14), and a mounting and positioning base (15); a front end of the main fuel sleeve (2) is connected to the mounting and positioning base (15); a front side of the mounting and positioning base (15) is provided with one pilot-stage liquid fuel port (11), one first-premix-stage gaseous fuel port (12), one second-premix-stage gaseous fuel port (13), and two second-premix-stage liquid fuel ports (14); and the pilot-stage liquid fuel port (11), the first-premix-stage gaseous fuel port (12), the second-premix-stage gaseous fuel port (13), and the second-premix-stage liquid fuel ports (14) are each configured to be threaded to a respective external fuel supply pipe.

3. The coaxially staged burner for the low-emission combustion chamber of the dual-fuel gas turbine utilizing gaseous and liquid fuels according to claim 2, wherein the main fuel sleeve (2) is internally provided with a pilot-stage liquid fuel pipe (21), a first-stage gaseous fuel annular cavity (221), a first-stage gaseous fuel pipe (222), a second-stage gaseous fuel annular cavity (231), a second-stage gaseous fuel pipe (232), a second-stage liquid fuel annular cavity (241), a second-stage liquid fuel pipe (242), and a plurality of oil supply branches (243); the second-stage gaseous fuel pipe (232), the first-stage gaseous fuel pipe (222), and the second-stage liquid fuel pipe (242) are annular pipes; the pilot-stage liquid fuel pipe (21), the second-stage gaseous fuel pipe (232), the first-stage gaseous fuel pipe (222), and the second-stage liquid fuel pipe (242) are arranged coaxially; a second-stage liquid fuel transition cavity (244), the second-stage gaseous fuel pipe (232), the first-stage gaseous fuel pipe (222), and the second-stage liquid fuel pipe (242) are arranged sequentially from inside to outside around the pilot-stage liquid fuel pipe (21); an inner wall of a rear end of the pilot-stage liquid fuel pipe (21) is provided with the second-stage liquid fuel transition cavity (244); a thin wall is disposed between the pilot-stage liquid fuel pipe (21) and the second-stage liquid fuel transition cavity (244); and the second-stage liquid fuel transition cavity (244) and the second-stage liquid fuel pipe (242) communicate in a sealed manner via the plurality of oil supply branches (243) arranged circumferentially.

4. The coaxially staged burner for the low-emission combustion chamber of the dual-fuel gas turbine utilizing gaseous and liquid fuels according to claim 3, wherein a front end of the pilot-stage liquid fuel pipe (21) communicates with the pilot-stage liquid fuel port (11); a front end of the second-stage gaseous fuel pipe (232) communicates with the second-stage gaseous fuel annular cavity (231); the second-premix-stage gaseous fuel port (13) communicates with the second-stage gaseous fuel annular cavity (231); a front end of the first-stage gaseous fuel pipe (222) communicates with the first-stage gaseous fuel annular cavity (221); the first-premix-stage gaseous fuel port (12) communicates with the first-stage gaseous fuel annular cavity (221); a front end of the second-stage liquid fuel pipe (242) communicates with the second-stage liquid fuel annular cavity (241); and the two second-premix-stage liquid fuel ports (14) communicate with the second-stage liquid fuel annular cavity (241).

5. The coaxially staged burner for the low-emission combustion chamber of the dual-fuel gas turbine utilizing gaseous and liquid fuels according to claim 4, wherein the liquid fuel nozzle (6) communicates with a rear end of the pilot-stage liquid fuel pipe (21); the plurality of first-stage full blades (7) are arranged at equal intervals around the axis of the pilot-stage bluff body (10); each of the plurality of first-stage full blades (7) is internally provided with a first-stage blade gaseous fuel cavity (72), a first-stage blade gaseous fuel delivery pipe (73), and a first-stage blade liquid fuel delivery pipe (74); the first-stage blade gaseous fuel cavity (72) communicates with the first-stage gaseous fuel pipe (222); an outer wall of the first-stage blade gaseous fuel cavity (72) is provided with a plurality of first-stage blade fuel holes (71); an end of the first-stage blade gaseous fuel delivery pipe (73) communicates with the second-stage gaseous fuel pipe (232); and an end of the first-stage blade liquid fuel delivery pipe (74) communicates with the second-stage liquid fuel transition cavity (244).

6. The coaxially staged burner for the low-emission combustion chamber of the dual-fuel gas turbine utilizing gaseous and liquid fuels according to claim 1, wherein the first-stage hub (4) is a cavity structure; and the first-stage hub (4) is internally provided with a gaseous-liquid fuel separation plate (42) separating an internal space of the first-stage hub (4) into a first-stage hub gaseous fuel flow rectification cavity (41) and a first-stage hub liquid fuel flow rectification cavity (43).

7. The coaxially staged burner for the low-emission combustion chamber of the dual-fuel gas turbine utilizing gaseous and liquid fuels according to claim 6, wherein an end of a first-stage blade liquid fuel delivery pipe (74) communicates with the first-stage hub liquid fuel flow rectification cavity (43); an end of a first-stage blade gaseous fuel delivery pipe (73) communicates with the first-stage hub gaseous fuel flow rectification cavity (41); the second-stage blade gaseous fuel cavity (82) communicates with the first-stage hub gaseous fuel flow rectification cavity (41); and the second-stage blade liquid fuel cavity (92) communicates with the first-stage hub liquid fuel flow rectification cavity (43).

8. The coaxially staged burner for the low-emission combustion chamber of the dual-fuel gas turbine utilizing gaseous and liquid fuels according to claim 1, wherein the plurality of first-stage full blades (7), the plurality of second-stage full blades (8), and the plurality of second-stage split blades (9) have an identical swirl direction; and mounting angles of the plurality of second-stage full blades (8) and the plurality of second-stage split blades (9) are in a range of 45°-52°.

* * * * *